US006176044B1

(12) United States Patent
Nixon et al.

(10) Patent No.: US 6,176,044 B1
(45) **Date of Patent: *Jan. 23, 2001**

(54) UNDERGROUND DOOR OPERATING APPARATUS AND METHOD

(75) Inventors: Angelo Nixon, Carlsbad; Edward Preston Murphy, Monrovia, both of CA (US)

(73) Assignee: Pacific Architectural Systems, Inc., Carlsbad, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/932,528

(22) Filed: Sep. 18, 1997

(51) Int. Cl.[7] ..... B06B 3/00; E05F 15/02
(52) U.S. Cl. ..... 49/506; 49/334
(58) Field of Search ..... 49/333, 334, 335, 49/338, 339, 340, 341, 506

(56) References Cited

U.S. PATENT DOCUMENTS 1,129,391 * 2/1915 Hohne et al. ..... 49/334
1,367,931 * 2/1921 Varnum ..... 49/334
1,637,575 * 8/1927 Kushlan et al. ..... 49/334
3,210,067 * 10/1965 Ferguson et al. ..... 49/334
3,864,875 * 2/1975 Hewitt ..... 49/334
4,599,824 * 7/1986 Mitsuhashi et al. ..... 49/334
5,036,620 * 8/1991 Beral et al. ..... 49/334
5,123,204 * 6/1992 He ..... 49/334
5,417,011 * 5/1995 Keszthelyi ..... 49/334

* cited by examiner

*Primary Examiner*—Daniel P. Stodola
*Assistant Examiner*—Curtis A. Cohen
(74) *Attorney, Agent, or Firm*—Myers, Dawes & Andras LLP

(57) ABSTRACT

A door assembly includes a door automatically operable relative to a floor and further comprises an electromechanical power device disposed beneath the floor and providing a rotary output on a shaft. The support apparatus includes a spindle adapted to receive power from the rotary shaft beneath the floor and to extend above the floor into a coupled relationship with the door. A bearing included in the support apparatus supports the spindle and at least a portion of the weight of the door beneath the floor. The electromechanical device can be of the type commonly used in overhead systems, in which case the power device can be retrofitted with the support apparatus for disposition beneath the floor. A coupling mechanism in the support apparatus can include pulleys, sprockets and gears, and power transfer devices such as belts and chains.

14 Claims, 2 Drawing Sheets

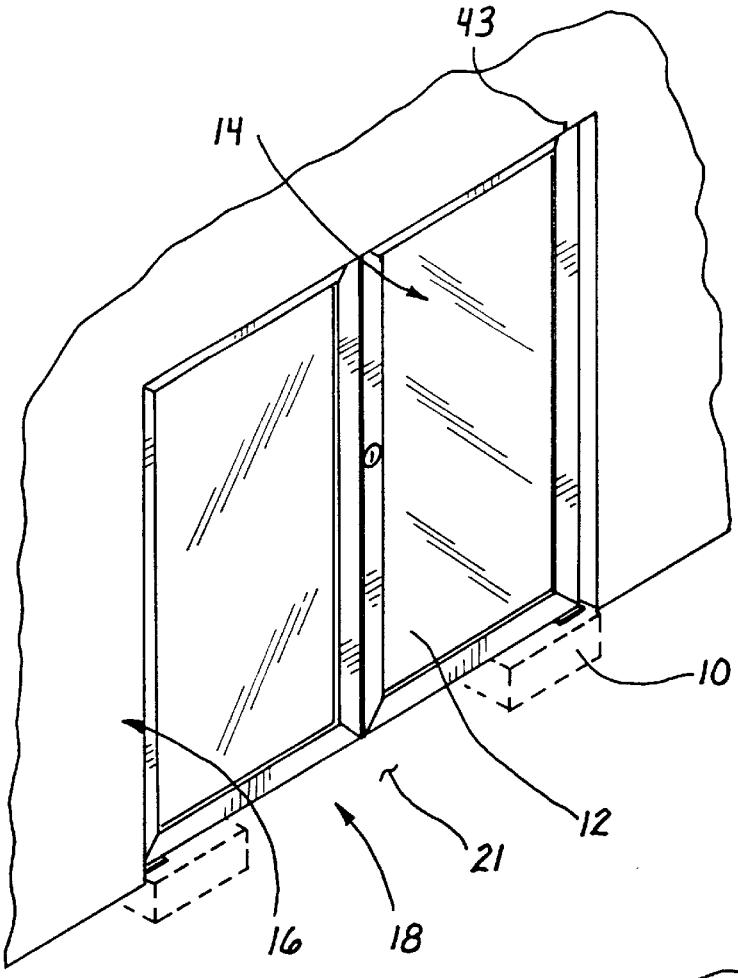
Fig. 1
Fig. 3
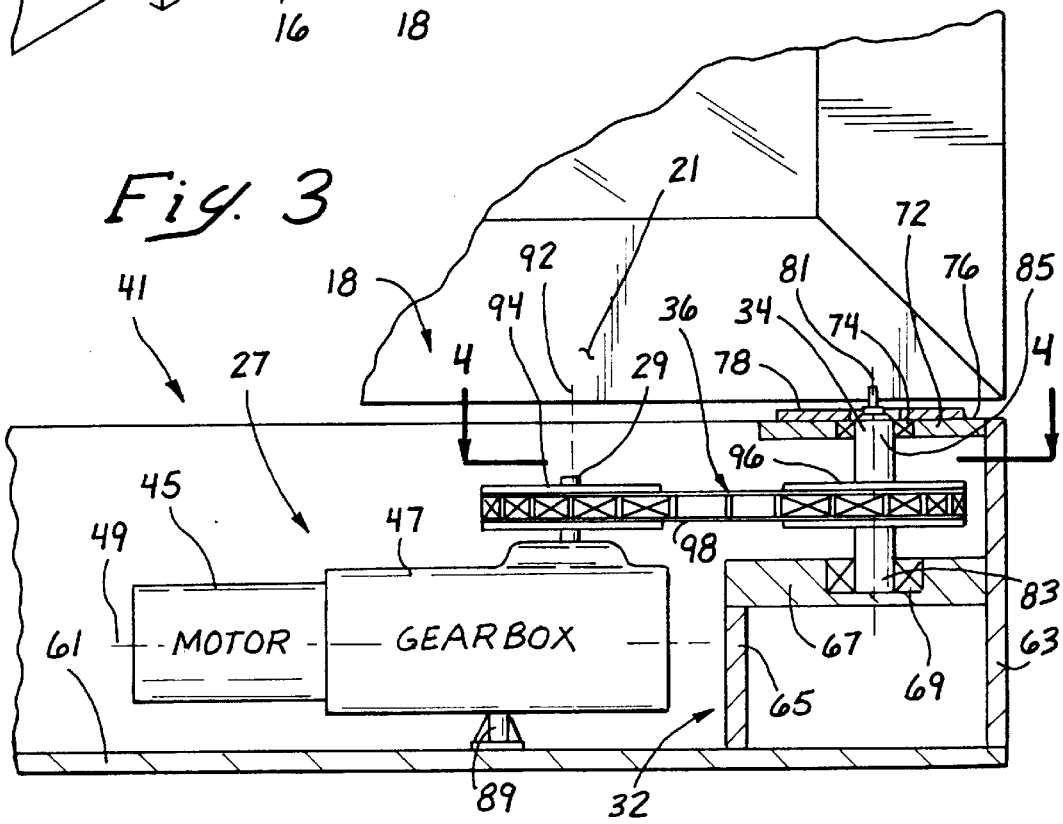

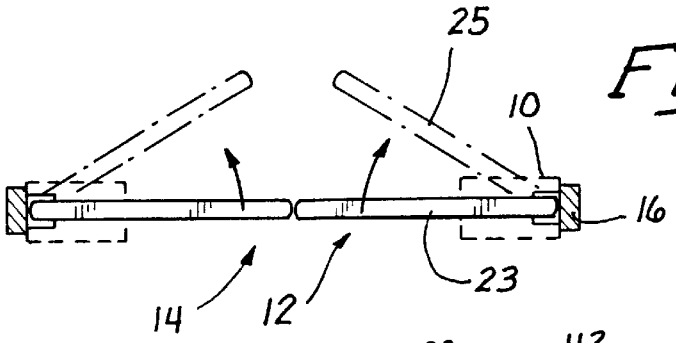
Fig. 2
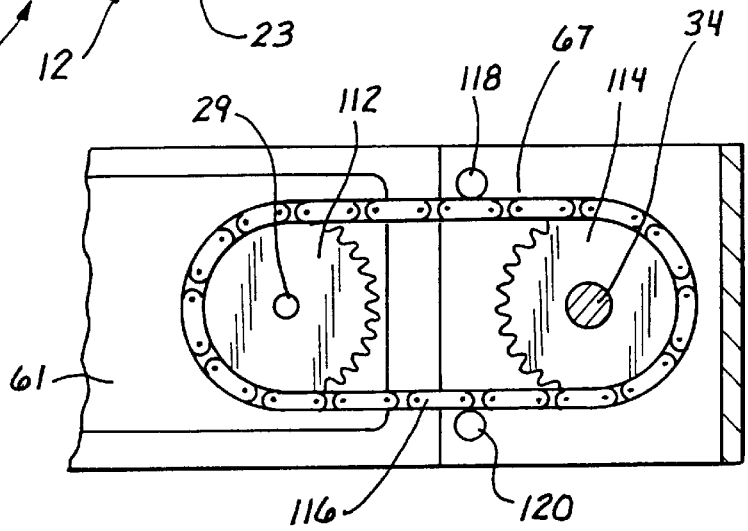
Fig. 4
Fig. 5
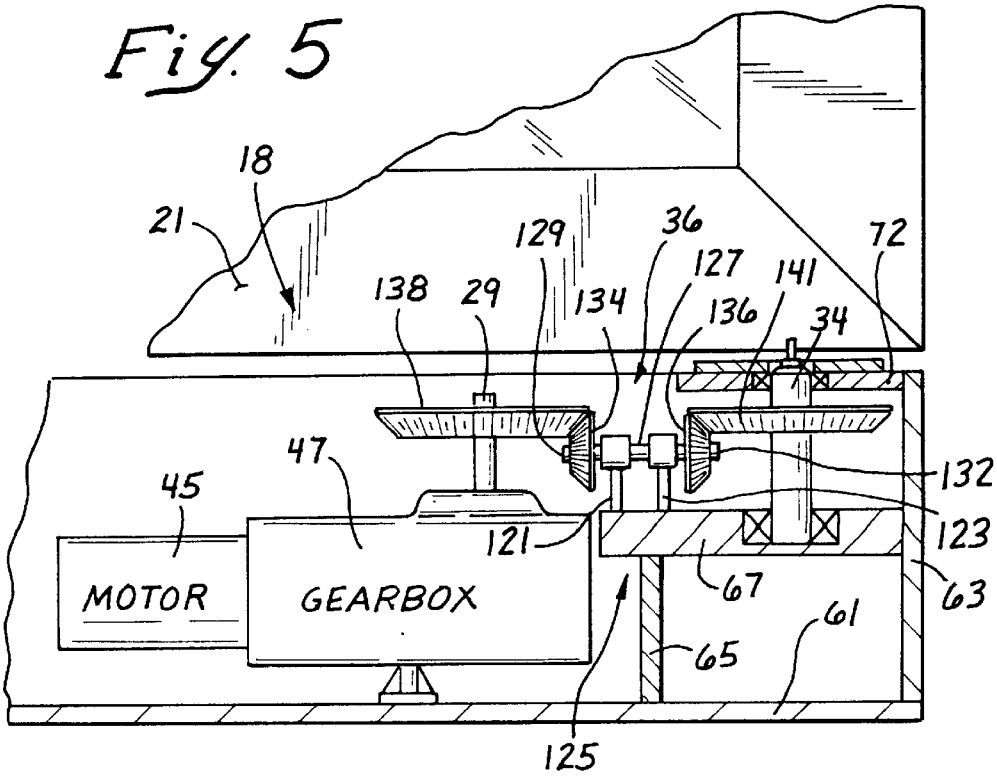

UNDERGROUND DOOR OPERATING APPARATUS AND METHOD

BACKGROUND OF THE INVENTION

1. Field of the Invention

This invention related generally to automatic swing door operation systems and more specifically to electromechanical swing door operator assemblies used in such systems.

2. Discussion of the Prior Art

Swing doors capable of automatically opening and closing are required by many building codes. For example, such doors are commonly required in public buildings where they facilitate ingress and egress of people with respect to the building. These automatic systems are particularly appreciated by the handicapped as well as others whose hands are in use and therefore unavailable to mechanically open and close the door. Automatic swing door systems were originally manufactured for below-ground installation. These early systems were hydraulically controlled and required major underground plumbing of hydraulic tubing. Large remote locations were also required underground for an associated hydraulic sump and electronic controls.

These large and messy systems were soon obsoleted in favor of electromechanical swing door operators. However, these electromechanical swing door operators have only been used in overhead systems. A new generation of electrohydraulic swing door operators have also been solely adapted for overhead installation.

Overhead installations are undesirable for many applications. For example, historic buildings with antique doors need automatic systems in order to satisfy handicap access codes. Unfortunately, these buildings can only be accommodated with a significant alteration to the overhead configuration of the building. This significantly defeats the maintenance of the historic appearance. Other types of buildings, such as those including monumental glass systems, need an underground operator system to automate the door while maintaining the aesthetics of a "structure-free" glass system. In other cases, there simply is not sufficient overhead room to install a standard operator while maintaining minimum height codes.

SUMMARY OF THE INVENTION

In accordance with the present invention, a swing door operation system includes an electromechanical operator and structural support assembly both of which are mounted beneath the surface of the floor. The operator provides sufficient power to open and close the door, but is not subjected to the axially weight or torque associated with the door. On the other hand, the structural assembly includes a spindle which is disposed beneath the floor surface but extends above the floor surface in a coupled relationship with the door. A first bearing plate is included in the support structure and adapted to receive a first bearing which supports the axial door load on the spindle. A second bearing plate is provided to receive a second bearing which opposes the lateral load on the spindle. A power transfer assembly is disposed between the first plate and the second plate and adapted to receive power from the electromechanical device and to transfer that power to the spindle for opening and closing the door.

The entire apparatus with the exception of the spindle, is mounting entirely beneath the floor surface where it does not interfere with the aesthetics of historic buildings or predominately glass structures. Furthermore, it is adapted to support the total weight of the door without damage to the electromechanical operator. Various transfer systems including pulleys, sprockets, gear, belts and chains can be employed to transfer power from the electromechanical drive to the spindle of the structural assembly.

In one aspect of the invention, a conversion assembly is adapted for use in an automatic door closing mechanism which includes a door pivotal on a vertical axis and an electrical power device which is adapted for use in an overhead door closure apparatus. This conversion assembly includes a support structure for pivotally supporting the door, and a first bearing plate included in the support structure and adapted to receive the weight of the door. A spindle having an axis extending between a first end and a second end is supported by the first bearing plate. A second bearing plate included in the support structure is disposed at the second hand of the spindle in a fixed relationship with the first bearing plate. A coupling mechanism in the support structure is disposed between the first bearing plate and the second bearing plate, and is coupled to receive power from the electrical power device to deliver that power through the spindle in the door to pivot the door about the vertical axis.

In another aspect of the invention, a door assembly includes a door automatically operable relative to a floor where the assembly comprises an electromechanical power device disposed beneath the floor and providing a rotary output on a shaft. A support apparatus including a spindle is adapted to receive power from the rotary shaft below the floor with the spindle extending above the floor in coupled relationship to the door. A bearing included in the support apparatus supports the spindle on at least a portion of the weight of the door beneath the floor.

In a further aspect of the invention, a method for constructing an automatic swing door operating system for use beneath a floor surface, comprises the steps of providing an electrical power device adapted for use in an over-the-door system. The method includes steps for providing a structural assembly adapted to support the weight of the door and configured to include a spindle rotatable about an axis. Coupling the electrical power device to the structural assembly facilitates rotation of the spindle by the device. The electrical power device is anchored together with at least a portion of the structural assembly beneath the surface of the floor and the door mounted on the spindle.

DESCRIPTION OF THE DRAWINGS

FIG. 1 is a perspective view of a double swing door system;

FIG. 2 is a top plan view of the door system of FIG. 1 illustrating open and closed positions;

FIG. 3 is a side elevation view of an underfloor door operating apparatus including sprockets and a chain;

FIG. 4 is a top plan view of the apparatus taken along lines 4—4 of FIG. 3; and FIG. 5 is a side elevation view of a further embodiment of the door operating apparatus including a direct gear drive.

DESCRIPTION OF THE PREFERRED EMBODIMENTS

An underfloor automatic swing door operation assembly is illustrated in FIG. 1 and is designated generally by the reference numeral 10. The assembly 10 is adapted for use in automatically opening and closing a swing door 12 having a pivot axis 13. The door 12 is adapted to fill a door opening 14 defined by a door jam 16 and floor 18. The surface of the floor 18 is designated by the reference numeral 21.

The door 12 is adapted for operation by the assembly 10 to move between a closed position 23 and an open position 25. In the closed position, the door 12 is disposed in proximity to the door jam 16 and fills the opening 14. In the open position 25, the door 12 is displaced from the opening 14 to permit access for people and objects passing into or out of the associated building.

The operation assembly includes an electromechanical device 27 which converts electrical energy into mechanical rotary energy on an output shaft 29. The assembly also includes a structural support apparatus 32 with a spindle 34 that pivotally supports the weight and torque of the door 12. A power transfer unit 36 couples the output shaft 29 of the electromechanical device 27 to the spindle 34 of the structural support apparatus 32 in order to provide motive power for automatically opening the door 12.

A cavity 41 is formed beneath the surface 21 of the floor 18 and provided with a size sufficient to receive and anchor the operation assembly 10. With the exception of a portion of the spindle 34, the entire operation assembly 10 including the electromechanical device 27, the structural support apparatus 32, and the power transfer unit 36, is disposed within the cavity 41 beneath the surface 21 of the floor 18. Accordingly, there is no automatic door operating assembly required above the door 12. This makes the assembly 10 particularly desirable for historic buildings, glass monument structures and other environments where an overhead assembly would be aesthetically undesirable or mechanically impossible. The cavity 41 is generally of minimal size and does not require a hydraulic reservoir, large electronic equipment or significant plumbing associated with underfloor systems of the past. It only requires one conduit for power and one conduit for low voltage control.

The only overhead door structure required is a pivot pin 43 which extends on the pivot axis 13 between the door 12 and the door jam 16. It will be noted that this pivot pin 43 does not need to support any of the weight associated with the door 12.

Of particular interest to the present invention is the fact that the electromechanical device 27 can be of the type presently adapted for use in overhead swing door closure systems. In these systems, the electromechanical device 27 is not adapted to support the weight of the door. However, the device 27 typically includes an electrical motor 45 which is coupled to a transmission 47 having an output shaft such as the shaft 29. The motor 45 and transmission 47 are generally disposed along a common longitudinal axis 49 with the output shaft 29 extending laterally, generally perpendicular of this axis 49.

In accordance with one embodiment of the present invention, the electromechanical device 27 is adapted to function within the underfloor operation assembly 10. A conversion unit 52 including the structural support apparatus 32 and the power transfer unit 36, can be retrofit to the electromechanical device 27 and anchored within the underfloor cavity 41.

In a preferred embodiment of the structural support apparatus 32, a generally horizontal base plate 61 is coupled to an upstanding back plate 63, and a gusset plate 65 which is generally parallel to the back plate 63 and perpendicular to the base plate 61. A first bearing plate 67 is disposed in generally parallel relationship with the base plate 61 and supported by the gusset plate 65 and back plate 63. The first bearing plate 67 is configured to receive a bearing 69 of the type commonly referred to as a support bearing or thrust bearing.

A second bearing plate is also coupled to the back plate 63 in generally parallel but spaced relationship to the first bearing plate 67. The second plate 72 is sized and configured to receive a bearing 74 of the type commonly referred to as a lateral bearing. In this embodiment, the second bearing 72 has a top surface 76 which extends generally in the plane of the surface 21 of the floor 18. A housing plate 78 disposed above the surface 21 of the floor 18, aids in maintaining the lateral bearing 74 in the bearing plate 72.

In the illustrated embodiment, the spindle 34 has an axis 81 extending between a first end 83 and second end 85. The first end 83 is seated on the bearing 69 and supports all the weight and some of the torque associated with the door 12. At the second end 85, the spindle 34 is seated in the lateral bearing 74 where it supports some of the torque associated with movement of the door 12. A spindle-to-door arm connector 87 is provided at the second end 85 and coupled to the door 12 along the axis 13. Thus the axis 81 of the spindle 34 and the axis 13 of the door 12 are generally aligned, and the door 12 pivots in a generally fixed relationship with the spindle 34. The pivoting of the spindle 34 is of course accommodated by the bearings 69 and 74 in the plates 67 and 72, respectively.

As illustrated in FIG. 3, the electromechanical device 27 can be mounted on a support 89 connected to the base plate 61. In a preferred orientation, the output shaft 29 of the transmission 47 extends upwardly in generally perpendicular relationship to the base plate 61 and surface 21 of floor 18. In this upstanding orientation, the output shaft 29 has an axis 92 which is generally parallel to but spaced from the axis 81 of the spindle 34.

With the electromechanical device 27 mounted on or retrofit to the base plate 61, the power transmission unit 36 can be coupled between the output shaft 29 and the spindle 34. This power transmission unit 36 can take many different forms, some of which include a rotary-to-linear converter 94 attached to the output shaft 29 and a linear-to-rotary converter attached to the spindle 34. A linear-to-linear transfer device 98, which preferably forms a continuous loop, can be used to couple the converter 94 to the converter 96 in order to transfer the motive power of the electromechanical device 27 to the spindle 34.

In most cases, the converters 94 and 96 will be of the same type, and the transfer device 98 will be adapted to that type of converter. For example, in one embodiment, the converters 94 and 96 are in the form of pulleys having a typical circumferential cog belt pulley, and the transfer device 98 is in the form of a common cog belt. This same function can be accomplished with an embodiment wherein the converters 94 and 96 are in the form of gears having teeth. A complementary tooth belt can provide the transfer device 98 in this unit 36.

In still a further embodiment illustrated in FIG. 4, the converters 94, 96 can be provided in the form of sprockets 112 and 114, respectively. In such a unit, the transfer device is preferably provided in the form of a chain 116. In any of these embodiments, the transfer device 98, whether in the form of a belt 103 or 111, or a chain 116, can be provided with idler pulleys 118, 120 as illustrated in top view of FIG. 4.

In another aspect of the invention, the power transfer unit 36, the transfer device 98 takes the form of a pair of upstanding supports 121 and 123 which are mounted on an extension 125 of the first bearing plate 67. The supports 121, 123 are adapted to receive a shaft 127 which is coupled at its opposing ends 129, 132 to a pair of beveled gears 134, 136, respectively. In this embodiment, the converters 94, 96 are also provided in the form of beveled gears 138, 141. In operation, the bevel gear 138 meshes with the bevel gear 134 to turn the shaft 127. This also turns the bevel gear 136 which meshes with the bevel gear 141 to turn the spindle 34. The cost of this embodiment may be greater than those previously discussed, but it provides a more direct drive and perhaps a quieter operation. Alignment of the power transfer unit 36 in either embodiment can be facilitated by providing the support 89 with properties for being adjustably fixed to the base plate 61 at an infinite number of positions relative to the back plate 63.

It will be apparent that there are many variations on the foregoing embodiments which are all within the scope of this concept. For example, the operation assembly 10 can be provided either as a retrofit unit for an existing electromechanical device 27, or the device 27 can be specifically adapted for the below floor mounted assembly 10. In either case, the weight and torque of the door 12 is supported by a structural support apparatus 32 which is separate from the electromechanical device 27. Accordingly, the device 27 is subjected only to the power requirements of the door 12 and spindle 32.

Various other embodiments can achieve these same advantages. For example, the output shaft 29 can be oriented perpendicular to the spindle 34 with appropriate gearing provided in the power transfer unit 36. Additionally, it will also be apparent that the converter 96, although preferably disposed between the plates 67 and 72 can be coupled to the spindle 34 at any location along its length. In other variations, the converters 94, 96 may not be disposed in the same planar relationship as illustrated in FIG. 5, but may be disposed in a different relationship, for example where the bevel gears 134 and 136 are of different sizes. Particularly in the embodiment of 5 the converters 94, 96 and transfer device 98 can be formed from a variety of metal or plastic materials well known in the art.

Given these wide variations, which are all within the scope of this concept, one is cautioned not to restrict the invention to the embodiments which have been specifically disclosed and illustrated, but rather encouraged to determine the scope of the invention only with reference to the following claims.

What is claimed is:

1. A method for constructing an automatic operating system for a door pivotally mounted relative to a surface of a floor, comprising the steps of:

removing an over-the-door electrical power device from an over-the-door operating system;

providing an under-the-door structural assembly adapted to be mounted beneath the floor, the structural assembly including a spindle rotatable about an axis and adapted to support the weight of the door;

coupling the over-the-door electrical power device removed from the over-the door operating system to the under-the-door structural assembly to facilitate rotation of the spindle by the removed electrical power device;

anchoring the removed electrical power device and at least a portion the structural assembly beneath the surface of the floor; and mounting the door on the spindle to support the door on the under-the-door structural assembly and to automatically operate the door with the removed electrical power device.

2. The method recited in claim 1 wherein the over-the-door operating system includes power transfer components coupling the electrical power device to the door, and the method further comprises the steps of:

removing at least a portion of the power transfer components from the over-the-door operating system; and coupling the removed power transfer components between the removed electrical power device and the spindle in the under-the-door structural assembly.

3. The method recited in claim 2 wherein the power transfer components include gears.

4. The method recited in claim 2 wherein the power transfer components include sprockets and a chain.

5. The method recited in claim 2 wherein the power transfer components include pulleys and a belt.

6. A method for converting an automatic operating system of a door pivotally mounted relative to a floor and having an over-the-door operating system including a motor and power transfer components, comprising the steps of:

providing an under-the door structural assembly mountable beneath the floor and adapted to support the weight of the door, the structural assembly including a spindle rotatable on an axis;

removing at least the motor from the over-the-door operating system;

installing the motor removed from the over-the-door operating system, on the under-the-door structural assembly;

coupling the removed motor to the spindle of the under-the-door structural assembly; and mounting the structural assembly beneath the floor and in a weight-supporting and pivotal relationship with the door.

7. The method recited in claim 6, further comprising:

removing at least a portion of the power transfer components from the over-the-door operating system; and coupling the removed power transfer components between the removed motor and the spindle of the under-the-door structural assembly.

8. The method recited in claim 7 wherein the power transfer components include gears.

9. The method recited in claim 7 wherein the power transfer components include sprockets and a chain.

10. The method recited in claim 7 wherein the power transfer components include pulleys and a belt.

11. A method for converting an over-the-door operating system to an under-the-door operating system, the over-the-door operating system including a motor with means for transferring the power of the motor to a door, the over-the-door operating system being operable to pivot the door relative to a floor at a building site, comprising the steps of:

carrying to the site a structural assembly adapted for mounting beneath the door to support the weight of the door in an under-the-floor operating system;

removing from the over-the-door operating system at the site at least the motor;

installing the removed motor on the structural assembly of the under-the-door operating system; and anchoring the under-the-door operating system beneath the floor in a supporting and pivotal relationship with the door.

12. The method recited in claim 11 wherein the means for transferring power includes at least one gear.

13. The method recited in claim 11 wherein the means for transferring power includes at least one sprocket and a chain.

14. The method recited in claim 11 wherein the means for transferring power includes at least one pulley and a belt.

* * * * *